United States Patent [19]

Clements

[11] 4,023,764

[45] May 17, 1977

[54] APPARATUS FOR PRODUCING MONOLITHIC CAST CONCRETE STRUCTURES

[76] Inventor: Arthur C. Clements, 1507 Ponce de Leon, Santurce, P.R. 00909

[22] Filed: July 6, 1976

[21] Appl. No.: 702,477

[52] U.S. Cl. ..... 249/27

[51] Int. Cl.[2] ..... E04G 11/02; E04G 11/48; E04G 17/18

[58] Field of Search ..... 249/19, 27, 26

[56] References Cited

UNITED STATES PATENTS

| | | | |
|---|---|---|---|
| 1,925,775 | 9/1933 | Quick | 249/26 |
| 3,490,729 | 1/1970 | Luce et al. | 249/27 |
| 3,689,018 | 9/1972 | Pelle et al. | 249/26 X |
| 3,693,927 | 9/1972 | Jennings | 249/27 X |
| 3,822,853 | 7/1974 | Shelley | 249/27 |
| 3,826,460 | 7/1974 | Cost | 249/27 |
| 3,847,341 | 11/1974 | Stickler | 249/27 |
| 3,961,457 | 6/1976 | Zalewski | 249/26 X |

*Primary Examiner*—J. Howard Flint, Jr.
*Attorney, Agent, or Firm*—Arthur B. Colvin

[57] ABSTRACT

The present invention is directed to improvements in the art of producing monolithic concrete structures, and especially modular building components generally in the form of inverted U-shaped members of cast concrete. The invention is further directed to an improved apparatus, and more specifically an improved casting form assembly for the practice of the method hereinabove set forth.

7 Claims, 8 Drawing Figures

FIG. 1
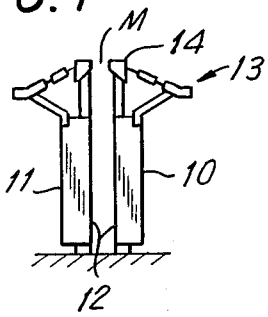
FIG. 2
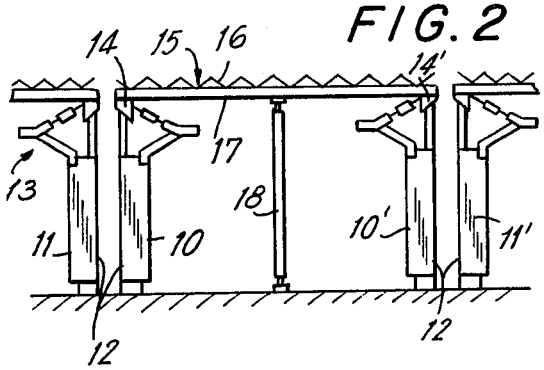
FIG. 3
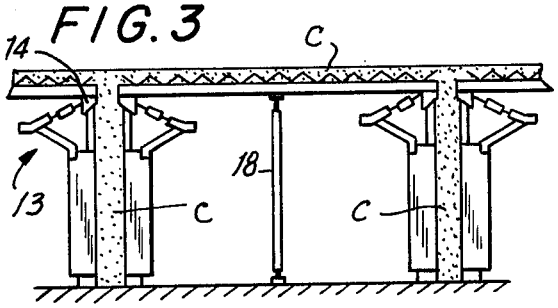
FIG. 4
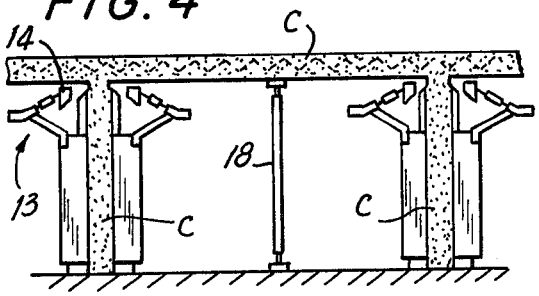
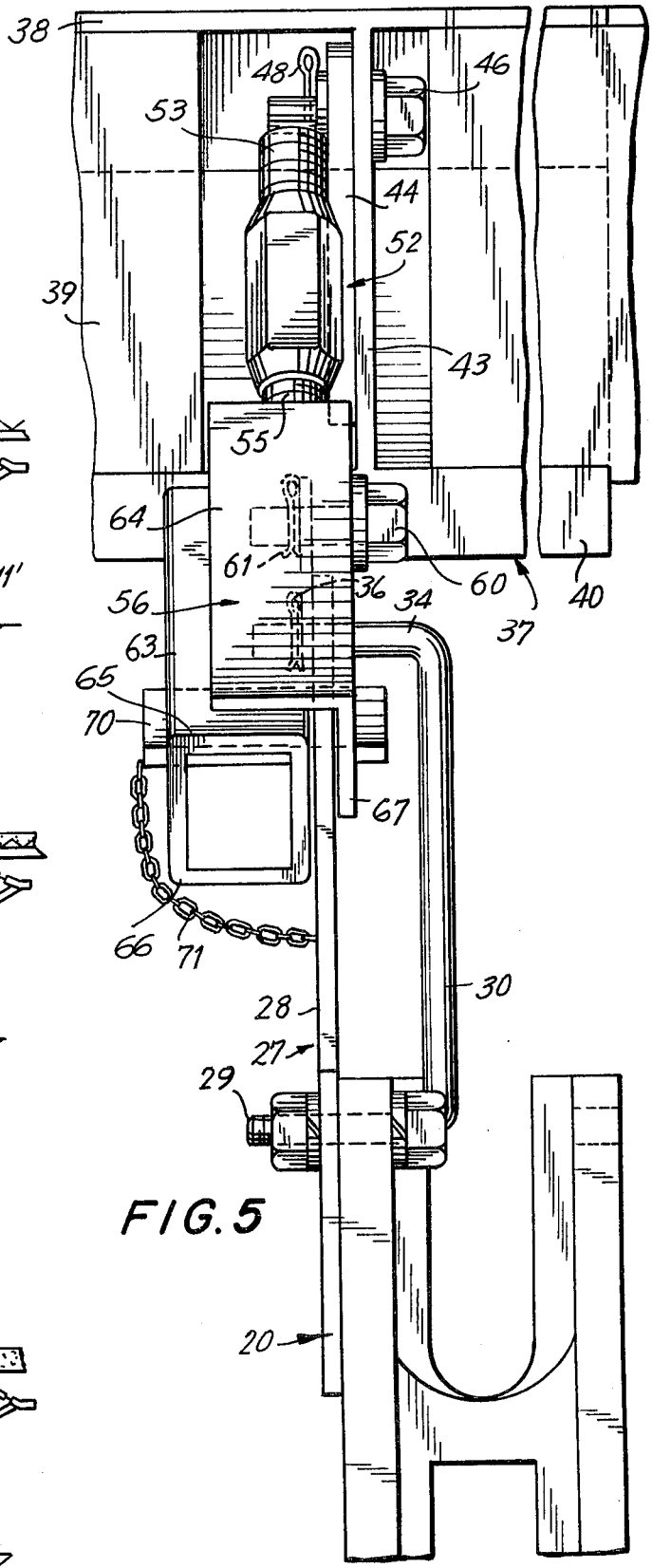
FIG. 5

APPARATUS FOR PRODUCING MONOLITHIC CAST CONCRETE STRUCTURES

BACKGROUND OF THE INVENTION

1. Field of the Invention

The present invention is in the field of producing monolithic concrete modules, particularly in the form of inverted U shapes which may be combined to form a variety of building structures, and to apparatus for producing the same.

2. The Prior Art

As conducive to an understanding of the present invention, it is to be noted that the use of cast concrete building structures and subassemblies is increasing, due to the substantially lower cost thereof as contrasted with buildings fabricated by other methods, e.g. steel frames and curtain walls.

Numerous methods have been proposed for simplifying and expediting the formation of concrete modules in situ. The most commonly employed method involves the erection of wall forms of plywood, aluminum, etc., pouring of concrete therein to define vertical wall sections, aging of the cast wall sections until the same are structurally capable of supporting a load, stripping of the forms, subsequent positioning or casting of a slab member on the walls and the re-erection atop the slab of the wall forms for repetition of the steps hereinabove set forth.

As is well known, numerous disadvantages inhere in the procedures above described. Specifically, the forms used to cast concrete are typically expensive to rent and relatively time consuming to erect. The necessity for permitting such forms to remain in position until cure of the concrete has been substantially completed necessarily extends construction time, with attendant increased rental costs and labor costs.

Additionally, the subsequent positioning of a slab over a cured wall member results in a relatively weak joint or connection between the wall and the slab as compared, for instance, with a monolithically cast slab-wall construction.

In order to avoid the difficulties which inhere in the use of the standard construction systems above described, numerous attempts have been made to devise a practical and efficient means of forming in situ monolithic casting forms wherein at least two supporting side walls and slab may be simultaneously cast. Examples of the methods and apparatus created for such purpose are described in U.S. Pat. Nos. 3490,729; 3558,095; 3676,536; 3689,018; 3815,861; and 3822,853.

The methods and apparatuses as exemplified in the above referenced patents involve deficiencies of various sorts which have greatly hampered their commercial acceptance. A principal difficulty resides in the cumbersome and complex nature of the form mechanisms and their consequent great expense, together with the difficulty of positioning such forms, especially in multi-story building constructions.

SUMMARY

The present invention may be summarized as directed to an improved apparatus enabling the formation in situ of monolithic concrete modules and particularly modules comprising inverted U structures. The method is characterized by the simplicity and lightness of the forms required to be employed, the facility with which the same may be stripped and erected, and the relatively shorter period of time which the forms are required to remain in place.

More particularly, in accordance with the method of practicing the use of the apparatus of the present invention, the U-shaped monolithic cast concrete module is formed in situ by erecting spaced parallel forms for the casting of parallel vertical wall components. A slab nucleus is provided, the nucleus being rigid and structurally capable of supporting concrete topping which, together with the nucleus, will form the slab.

The nucleus is structurally supported at its terminal ends on the forms, which in turn are provided with means for withdrawing support for the nucleus when the wall has achieved sufficient structural stability.

The nucleus may be propped centrally, as desired, whereby in addition a camber may be introduced, if desired.

Concrete is then poured into the forms, and a topping poured over the nucleus, whereby a monolithic structure is defined.

After partial curing of the concrete, the forms may be stripped, leaving the nucleus and topping supported on the green but partially cured walls and, if desired, on the propping. Importantly, the degree of cure necessary to be attained by the concrete prior to stripping is substantially less than that required where a precast concrete slab is to be positioned, whereby stripping is facilitated and form utilization increased.

For instance, in the conventional method a wall cure period of four or more days may be required before it is feasible to emplace or cast a slab section. In accordance with the method of using the apparatus of the present invention, the wall forms may be stripped and reused in two days.

In order better to understand the feasibility of removing the forms at an earlier stage, it should be recognized that the emplacement of a preformed slab involves subjecting areas of the partially cured wall to extreme localized pressure, i.e. when the slab is lowered into position, initial contact between the slab and wall may be localized. Such localized contact would subject the contacted area to pressures many times the pressures to which the same areas would be subjected if the weight of the slab were equally distributed.

Additionally, propping of a conventional slab can be carried out only after the same has been positioned, whereas in accordance with the method for using the apparatus of the present invention the far lighter slab nucleus is structurally supported on the wall forms and propped prior to pouring of the walls and topping of the nucleus.

The invention is more particularly directed to an improved wall form device especially adapted for use in connection with the above described method. The wall form device includes spaced parallel rigid members or panels defining the boundaries of the casting cell for the wall. The uppermost edge portion of at least one of the walls of the cell is provided with a support bar extending substantially the length of the form and defining the uppermost boundary of the form on which the slab nucleus is to rest.

The support bar, in turn, is mounted on a retractor mechanism which enables the bar to be shifted downwardly and inwardly, whereby the weight of the nucleus and cured topping is smoothly relieved from the bar and form components and transferred exclusively to the partially cured concrete contained within the cell, enabling the facile removal of the form for reuse.

Still more particularly, the form includes a beveled ledge against which the under surface of the support bar may rest, the weight of the bar and any materials, such as the slab nucleus mounted thereon, reacting through the bar to the ledge and to a bracket assembly mounted on the form. Mechanism is provided for withdrawing the bar while still maintaining contact between the bar and the ledge, the under surface of the bar being provided with a complementary angled portion mating with the angle of the ledge.

It is accordingly an object of the present invention to provide an improved apparatus for casting monolithic concrete modules, and particularly modules in the form of inverted U shapes.

A further object of the invention is the provision of apparatus for practicing a method which, broadly stated, involves structurally supporting an imperforate slab nucleus on spaced, vertically extending structural elements which also define the boundaries of a form for casting wall portions, thereafter pouring the wall portions and topping for the slab and, after partial curing of the concrete, removing the forms, leaving, if desired, the under surface of the slab nucleus propped, whereby the forms are freed for use in the formation of a still further monolithic said structure.

A further object of the invention is the provision of a form having as an uppermost component a retractible support member for the temporary support of the slab nucleus, the form being provided with mechanism for withdrawing in a downward and inward direction of the support upon curing of the concrete mass to a satisfactory degree.

A further object of the invention is the provision of an apparatus of the type described which is simple and inexpensive to practice and construct and easy to use even by relatively unskilled labor.

To attain these objects and such further objects as may appear herein or be hereinafter pointed out, reference is made to the accompanying drawings, forming a part hereof, in which:

FIGS. 1 to 4 are schematic views diagrammatically illustrating the sequential steps in practicing the method for using the apparatus in accordance with the invention;

FIG. 5 is a magnified end elevational view of an apparatus for controlling the support for the slab nucleus;

Figure 6:
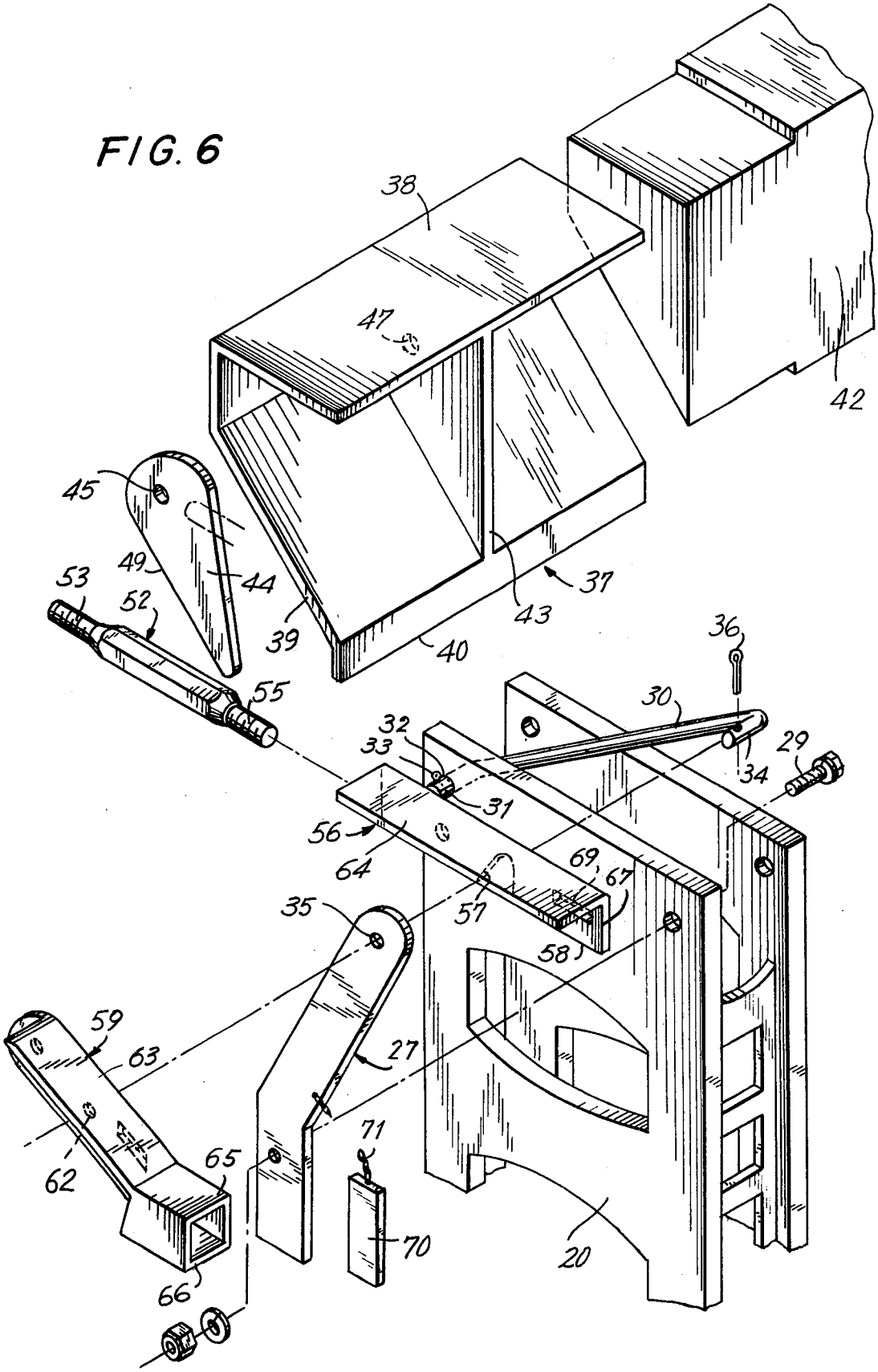
FIG. 6 is an exploded perspective view of the apparatus of FIG. 5.

Referring to FIGS. 1 to 4, there is shown a pair of form elements 10 and 11 utilized in the practice of the invention. The forms, which are used to define components of casting cells for the vertical walls, include inner wall defining portions or panels 12, 12, it being understood that the inner wall defining portions 12, 12 may be of any desired length and that at the terminal ends of the walls 12, 12 vertical strips (not shown) are provided to retain concrete poured into the mouth portion M from flowing laterally beyond the boundary of the form.

The uppermost ends of the wall defining portions 12, 12 are provided along substantially their entire length with retractible support assemblies 13, including a support bar member 14. As is apparent from FIG. 2 (wherein a plurality of U-shaped, side by side disposed monolithic structures are to be formed), a given subassembly will include at least two pairs of form assemblies 10, 11, it being understood that where only a single U-shaped structure is to be formed, only the inner said assemblies 10 will require the retractor apparatus 13.

In the stage represented by FIG. 2, a first pair of wall defining assemblies 10 and 11, and a second pair of wall assemblies 10' and 11' are disposed in parallel spaced relation. A slab nucleus 15, the longitudinal span of which approximates the spacing of the bars 14, 14' of the wall assemblies 10, 10', is mounted atop the said bars 14, 14'.

The slab nucleus 15, which is known per se, may comprise a lattice work 16 of steel rod or the like embedded in a relatively thin, precast layer 17 of concrete or like material. The weight of the slab nucleus 15, while considerable, is substantially less than the ultimate slab weight, the thickness of the layer 17 being, by way of example, two inches for a slab which will ultimately be six or more inches in thickness.

After emplacement of the slab nucleus 15, the center portion or portions thereof may be propped as desired, utilizing adjustable jacks 18. At this stage, due to the relative flexibility of the slab nucleus 15, a camber or slight curvature may be introduced into the slab nucleus by appropriate adjustment of the prop or jack 18 or, at least, the tendency of the nucleus to sag may be counteracted.

The next step to be followed in accordance with the method is the pouring of the concrete C into the space defined between the walls 12, 12 through the mouth portions M.

In the same operation, the slab nucleus 15 is provided with a layer or topping of cement C to achieve the desired slab thickness. Optionally but preferably, the marginal upper boundaries of the slab nucleus 15 may be provided with dished, upwardly extending increments of the precured concrete layer 17, facilitating the topping without the necessity for substantial additional carpentry work to define the lateral boundaries to retain the cement.

The concrete is next permitted to cure. Following partial cure of the concrete to a condition in which it is not only self-supporting but sufficiently structurally stable to bear the weight of the slab nucleus and topping, the retractor assemblies 13 are activated, withdrawing the support bars 14 in a downward and inward direction from the position shown in FIGS. 1 to 3 to the retracted position illustrated in FIG. 4.

The forms 10, 11 may now be stripped and removed for reuse at another location. If desired, the prop members or jacks 18 may be left in position and removed when the cure of the concrete has been further advanced, a period which may be as little as two to three days. This two to three day period is substantially shorter than required in accordance with traditional casting methods.

As noted, where a precast slab is used, the same may not be positioned until after the walls have been cured to a far greater degree than contemplated in the instant method in view of the subjection of the precast slab supporting walls to localized stresses of substantially greater nature than those encountered in the practice of the instant invention.

The use of the apparatus of the invention is obviously faster than a further traditional fabrication technique which involves first pouring the walls and thereafter erecting forms for the pouring of a slab. In the latter case, the structure is not completed until after the cure time for the walls has elapsed and, in addition, the subsequent cure time for the slab has also elapsed. It is only after the expiration of such latter cure time that the slab forms may be stripped and further stories erected above the slab. The method in accordance with the present invention has been determined to save at least about one third of the time required in the practice of conventional construction methods.

Referring now to the structure of the forms 10, 11, only one of which will be described due to their identity, the forms include vertically extending soldier beams 20, it being understood that each form has a plurality of parallel said soldier beams, the number of beams being dependent upon the overall length of the form. Extending vertically beyond the upper edges 21 of the soldier beams 20 are extension struts 22 which are beveled at their upper ends, as at 23.

Figure 7:
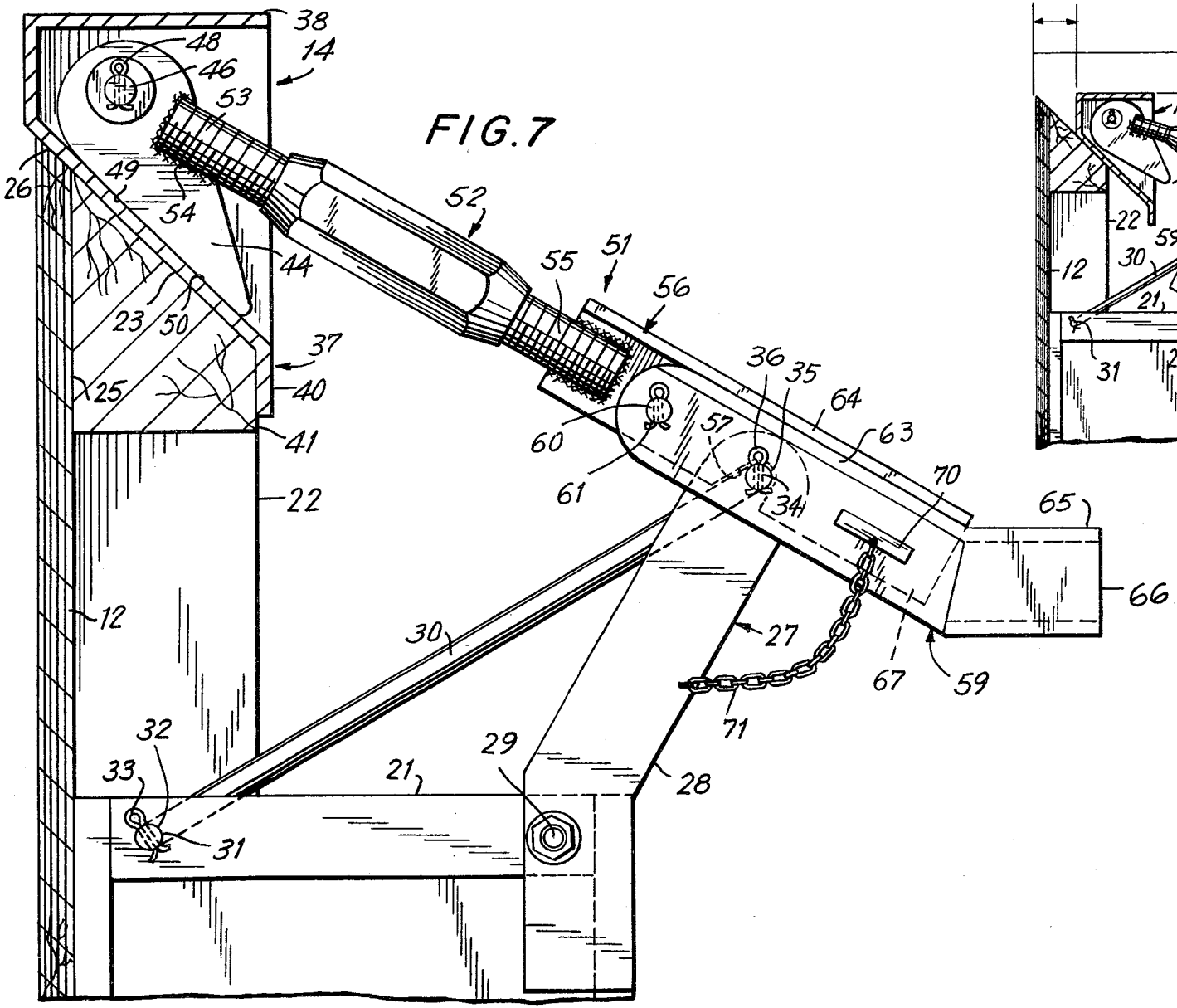
FIG. 7 is a side elevational view of the apparatus of FIG. 5 in its supporting position.

As best seen in FIG. 7, panel members 12, which are preferably formed of plywood sheets and which, in fact, define the boundary of the concrete casting cells, are fixed to the innermost face 25 of the extension 22 and soldier beam 21, the uppermost end 26 of the panels being beveled to form a continuation of the beveled portion 23.

A bracket assembly 27 extends upwardly and inwardly of the top 21 of the soldier beams 20, the bracket assembly including a reinforcing strut 28 fixed as by bolt 29 to the soldier beam. A reinforcing rod 30 has a lower offset end portion 31 extending through aperture 32 in the soldier beam adjacent the panel 12, the offset portion being locked in the aperture 32 by cotter pin 33.

The opposite offset end portion 34 of the rod 30 extends through an aperture 35 formed in the upper end of the strut 28, a cotter pin 36 maintaining the end 34 in position against retraction through the aperture.

It is to be noted that the aperture 35 in the strut 28 is disposed laterally inwardly of the mounting bolt 29 which supports the strut on the soldier beam, whereby forces transmitted inwardly against the strut will tend to stretch or tension the rod 30 rather than applying a compressive force thereto.

Figure 8:
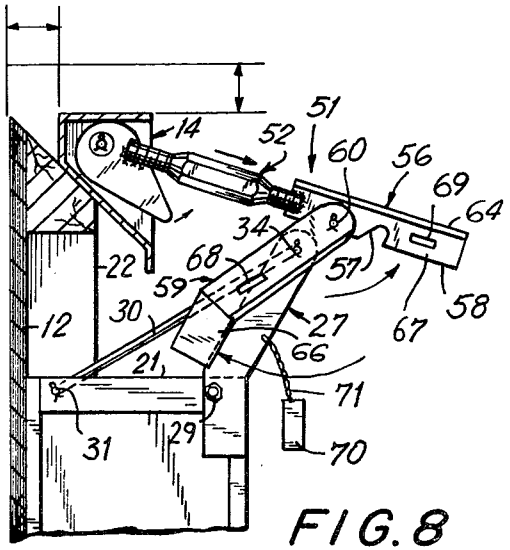
FIG. 8 is a view similar to FIG. 7, on a reduced scale, showing the position of the parts after the support has been withdrawn.

Support bar members 14, previously mentioned in connection with the description of the method of the present invention, are mounted to the bracket assembly 27 for shifting movement between operative or supporting positions as illustrated in FIG. 7, and retracted or non-supporting position as illustrated in FIG. 8.

The support bar assembly includes a metallic bar mounting frame 37 which, as best seen in FIG. 6, includes a top portion 38, a beveled under portion 39, and a vertically directed stop lip 40. As is clear by reference to FIG. 7, the beveled under portion 39 is formed at a complemental angle to the beveled portion 23 of the strut 22 so that, in the supporting position of FIG. 7, the angled portions 39 and 23 are disposed in intimate engaged relationship, with the lip 40 abutting the inner edge 41 of the strut.

It may be mentioned that the bar mounting frame 37 provides an anchor point for the retractor assembly 13, adjacent retractor assemblies being connected together by shoring bars 42 shaped to fit within the interior of the frames 37, it being appreciated that the central partition 43 of the frame provides a dividing line, with one shoring bar 42 extending laterally to one side of the partition and another shoring bar (not shown) extending in the opposite direction. Obviously, a single casting form must include at least two retractible support assemblies 13 connected by a single shoring bar 42, elongated structures encompassing a plurality of shoring bars and at least three retractible support assemblies.

The partition 43 provides a mounting plate for the pivotal link member 44. The link member, which may be generally teardrop shaped, is provided with a mounting aperture 45 adjacent its upper end, a headed mounting rod 46 passing through the mounting aperture 45 of the link and through a complemental aperture 47 formed in the partition 43. Transversely extending cotter pin 48 maintains the rod in its mounting position, whereby the link is pivotally secured to the partition 43.

It is to be noted that the under surface 49 of the link abuts the upper surface 50 of the beveled portion 39 of the frame 37, whereby only an upward pivotal movement, i.e. in an anticlockwise direction as viewed in FIG. 7, may be imparted to the link 44.

The lever assembly 51 includes a turnbuckle member 52, the innermost end 53 of the which is welded as at 54 to the link 44. The opposite end 55 of the turnbuckle member 52 is secured to an elongated angle bar 56.

The angled bar 56 includes a downwardly open receiver slot 57 on its under surface 58. A pry lever 49 is pivotally mounted on a headed cross bar 60 to the angle bar 56 of the lever assembly 51. The cross bar 60 extends through aligned apertures in the angle bar 56 and pry lever 49, being retained in position by a cotter pin 61. The pry lever 59 is likewise provided with an aperture 62, pivotally mounted on the offset portion 34 of the rod 30. The receiver slot 57 in the under surface of the angle bar 56 is likewise seated over the offset portion 34 of the bar 30.

The pry lever 59 includes an upper wall portion 63 which underlies offset wall portion 64 of the angle bar 56. The pry bar 59, at its innermost end 65, includes a hollow box formation 66 for the reception of a pry member, such as a timber. The pry lever 59 and the vertical arm 67 of the angle bar 56 are provided with rectangular apertures 68, 69, respectively, which apertures, in the loaded or weight supporting position, are disposed in alignment.

A locking wedge member 70 in the form of a tapered plate is adapted to be sleeved through the aligned rectangular apertures 68, 69 to lock the parts against pivotal movement when the same are in the loaded (weight supporting) position. Optionally, a chain member 71 may extend between the wedge 70 and some portion of the reinforcing strut 28 so as to prevent misplacement of the wedge.

The operation of the device will be apparent from the foregoing description.

The parts are first aligned in the manner shown in FIG. 7, with the under surface 50 of the various reinforcing frames 37 on a given form structure resting against the beveled upper surfaces 23 of the struts 22. Fine adjustment of the parts to achieve a precise heightwise location of the upper surface 38 of the frame 37 may be effected by operation of the turnbuckles 52. In the properly adjusted position, the pivot axis of pin 46 of the link, pin 60 connecting the bar or lever 56 to the pry bar 59, and pin 34 connecting pry lever 59 to the bracket 27 are substantially in alignment, whereby the initial retractile movements may be effected with a maximum mechanical advantage.

After the desired adjustment for the forms defining a particular modular form assembly have been achieved, the slab nucleus 15 is lowered into position, the weight of the nucleus being supported upon the transversely extending timbers 42 which, in turn, by virtue of their connection with the frames 37 and linkage mechanism previously described, support the weight thereof by reaction against strut 22 and bracket assembly 27.

At this juncture it is desirable to add props 18 to counteract any curvature resulting from sagging of the nucleus, and also to add any chamber to the nucleus which may be desired.

As earlier noted, concrete may now be poured into the vertical space defined between the opposed wall forms, and after the space for the forms is filled, topping may be added over the slab nucleus.

After the concrete has cured to a degree which may be readily determined on a case by case basis, depending upon thickness, variations of concrete mix, etc., the forms are stripped. The stripping operation is carried out as follows:

First the wedges 70 are knocked clear from their locking position within apertures 69, 68. Thereafter, a timber or like pry member is inserted into the box formations 66 in the pry levers 59. The pry (not shown) is forcibly shifted downwardly, the lever 59 pivoting about the pivot axis defined by the offset portion 34 of the rod 30. The downward movement of the pry end 66 of the lever 59 is accompanied by a concomitant upward and inward movement of the rod 60 pivotally connecting pry 59 with angle bar 56. With continued downward movement of the end 66, the bar 56 is lifted upwardly to the point where clearance slot 57 is freed from the offset portion 34.

Continued downward movement of pry lever 59 will result in upward pivotal movement of link 44 and a concomitant inward and downward movement of the frames 37 and their associated timbers.

The position of the parts after full activation of the pry levers is depicted in FIG. 8. It will be observed that after such retraction, the weight of the termini of the nucleus 15 and poured topping is now carried by the partially cured concrete walls. It is thus a simple matter to strip the forms for reuse at a different locality.

The props 18 are preferably left in position for removal after cure of the concrete has proceeded to a further stage. It may be observed that since jacks or props are relatively inexpensive to rent, e.g. approximately sixty to eighty cents per jack per month, the maintenance of the jacks in position after stripping of the forms does not materially add to the fabricating costs.

From the foregoing it will be appreciated that there is described a novel apparatus for the formation of inverted U-shaped monolithic concrete building modules. The novel casting method greatly expedites construction schedules and reduces costs by enabling forms to be reused at a far earlier stage in the concrete cure than is the case with methods heretofore known.

The structure of the form apparatus is relatively inexpensive, especially as contrasted with the complex tunnel forming-module casting apparatuses exemplified in the above referenced patents. The forms may be inexpensively built of readily available construction materials.

By reason of the novel retraction mechanism described, the withdrawal of the forms from their weight supporting condition is readily accomplished, due to the enormous mechanical advantage developed in the course of the releasing movements.

Skilled workers in the art who are familiarized with the above disclosures will readily discern that variations in the structure and specific method may be made without departing from the spirit of the invention. Accordingly, the invention is to be broadly construed within the scope of the appended claims.

Having thus described the invention and illustrated its use, what is claimed as new and is desired to be secured by Letters Patent is:

1. A wall form member for use in fabricating a monolithic inverted U-shaped concrete structure, said form including vertically extending spaced parallel panel members defining a downwardly open chamber, the upper terminal edge of one said panel member being defined by a bevel portion downwardly inclined at an acute angle with respect to the horizontal in a direction away from said other panel, a removable support bar mounted above said bevel portion having a top surface defining the uppermost portion of said form, said bar extending along substantially the entire length of said form and including a lower surface portion seated on and defining a complemental angle with said bevel portion and operator means extending between said support bar and said one panel for shifting said bar downwardly and inwardly while said lower surface of said bar is engaged with said bevel portion.

2. A wall form member in accordance with claim 1 wherein said operator means includes a link member horizontally pivotally mounted on said bar, a bracket member mounted on said one panel below and laterally inwardly offset from said bevel portion, and draw bar means having a first end connected to said link at a position displaced from said pivot, and a second end connected to said bracket for simultaneously rotating said link in an upward direction about said pivot and moving said link in said downward and inward direction.

3. A wall form member in accordance with claim 2 wherein said second end of said draw bar assembly includes a first lever pivotally mounted to said bracket about a first horizontal pivot axis, and a second lever extending from said link and horizontally pivotally connected to said first lever for movement about a second horizontal pivot axis, complemental stop means extending between said links for locking said levers at a limiting position against relative pivotal movement, said second pivot axis at said limiting position being disposed at a position substantially in a line extending through said first pivot axis and the pivot axis of said link, said simultaneous rotation and downward movement of said link assembly being effected responsive to movement of said second pivot axis to a position above said line.

4. A form member in accordance with claim 3 wherein said second pivot axis is interposed between said link and said first pivot axis.

5. Apparatus in accordance with claim 3 wherein said second lever includes lengthwise adjustment means interposed between said link and said second pivot axis.

6. Apparatus in accordance with claim 3 wherein said first lever includes a release portion extending to the side of said first pivot axis opposite from said link, said second pivot axis being shifted to a position above said line responsive to downward movement of said release portion.

7. Apparatus in accordance with claim 3 wherein said stop means comprises a pair of aligned apertures in said levers, and a wedge member removably mountable in said apertures.

* * * * *